US005878489A

United States Patent [19]

Shioda et al.

[11] Patent Number: 5,878,489

[45] Date of Patent: Mar. 9, 1999

[54] METHOD OF PRODUCING FLAT ELECTRIC WIRE HARNESSES

[75] Inventors: Ryousuke Shioda; Yosinobu Ohta, both of Nagoya, Japan

[73] Assignees: Sumitomo Wiring Systems, Ltd.; Harness System Technologies Research, Ltd.; Sumitomo Electric Industries, Ltd., all of, Japan

[21] Appl. No.: 759,946

[22] Filed: Dec. 3, 1996

[30] Foreign Application Priority Data

Dec. 5, 1995 [JP] Japan ..... 7-316718

[51] Int. Cl.[6] ..... H01R 43/00

[52] U.S. Cl. ..... 29/857; 29/33 F; 29/33 M; 29/564.6; 29/564.8; 29/566.1; 83/18; 83/950

[58] Field of Search ..... 29/33 M, 33 F, 29/749, 564.3, 564.4, 564.6, 747, 857, 566.1, 564.8; 83/18, 175, 277, 950; 140/140

[56] References Cited

U.S. PATENT DOCUMENTS

| | | | |
|---|---|---|---|
| 3,579,823 | 5/1971 | Gressitt . | |
| 4,029,006 | 6/1977 | Mercer | 101/35 |
| 4,646,404 | 3/1987 | Matsui | 29/33 M |
| 4,729,152 | 3/1988 | Hammond et al. | 29/33 M |
| 4,908,941 | 3/1990 | Fukuda et al. | 29/857 |
| 4,979,292 | 12/1990 | Fukuda et al. | 29/863 |
| 5,016,347 | 5/1991 | Okazaki et al. | 29/33 M X |
| 5,067,399 | 11/1991 | Berry | 101/11 |
| 5,074,038 | 12/1991 | Fath | 29/33 M X |

FOREIGN PATENT DOCUMENTS 2068786 8/1981 United Kingdom .

*Primary Examiner*—Peter Vo
*Assistant Examiner*—Rick Kiltae Chang
*Attorney, Agent, or Firm*—Jordan B. Bierman; Bierman, Muserlian and Lucas

[57] ABSTRACT

An inexpensive flat electric wire for a wire harness and an inexpensive wire harness utilizing the flat electric wire can be produced. A flat electric wire (P) is produced by juxtaposing a plurality of insulator-sheathed electric wire elements (a), each having a single core, on a plane; and by applying a reinforcing tape (51) on the juxtaposed wire elements (a) at a desired position over the width of the elements (a), whereby the wire elements (a) are secured together to each other by the tape (51) to form the flat electric wire (P) for a wire harness. A wire harness (d) having connectors at opposite ends is produced by winding the flat electric wire (P) for a wire harness on a reel (61) beforehand; by drawing the flat electric wire (P) from the reel (61); by measuring and cutting (A) the flat electric wire (P); by carrying the cut-off flat electric wire (P) in a juxtaposed direction while holding opposite ends of the cut-off flat electric wire (P) by grippers; and by treating opposite ends of the cut-off flat electric wire (P) during the carrying step by means of stripping (B) the insulator sheath, connecting (C) terminals (t), and attaching (D) connectors (C).

2 Claims, 13 Drawing Sheets

METHOD OF PRODUCING FLAT ELECTRIC WIRE HARNESSES

BACKGROUND OF THE INVENTION (1) Field of the Invention

This invention relates to a flat electric wire for a wire harness in which a plurality of insulation-sheathed wires are juxtaposed on a plane, a method and an apparatus of producing the flat electric wire and a method and an apparatus of producing a wire harness utilizing the flat electric wire.

(2) Statement of the Prior Art

Electrical devices in an automotive vehicle or common devices are electrically interconnected by wire harnesses. For convenience of explanation, such a kind of a conventional wire harness will be described below by referring to FIGS. 16 to 22. FIG. 16 is a perspective view of a typical wire harness. FIG. 17 is an explanatory view illustrating a position of applying the reinforcing tape for the flat electric wire and an operation of termination treatment. FIGS. 18(*a*) and 18(*b*) are explanatory views illustrating the position for applying the reinforcing tape and the operation of termination treatment. FIG. 19 is a perspective view of a conventional flat electric wire. FIG. 20 is a schematic view illustrating a conventional apparatus for producing a wire harness. FIG. 21 is a schematic view illustrating another conventional apparatus for producing a wire harness. FIG. 22 is a schematic view illustrating still another conventional apparatus for producing a wire harness.

A typical wire harness, as shown in, for example, FIG. 16, has a plurality of insulator-sheathed electric wire elements a and connectors attached to opposite ends of the wire elements a. As shown in FIGS. 20 and 21, each wire element a is treated at its end and then inserted into each connector c through a terminal t.

A method shown in FIG. 20 comprises the steps of: drawing the wire element a from a wire supply S; cutting off the wire element a by a given length by means of a measuring device A; stripping an insulator-sheath at opposite ends of the wire element a by means of a striping device B; connecting terminals t to the stripped ends of the wire element a; carrying the wire elements a with terminals on their opposite ends to a connecting device D; and attaching the connectors C to opposite ends of the wire elements a.

Another method shown in FIG. 21 comprises the steps of: preparing a plurality of supplies S having different electric wire elements a; selecting a desired one of the wire elements a from the respective supplies S and cutting off the selected element a by a desired length by means of a measuring device A; clamping the cut-off element a at its opposite ends by grippers g; and treating opposite ends of the cut-off element a by carrying the cut-off element a to a sheath stripper B, a terminal connecting device C and a connector attaching device D.

However, in these methods, the treating work of the wire elements a is troublesome since the wire elements a must be treated at a time. The number of circuits (electric wire elements) between the connectors c increases with progress in electronics. In the case of producing a wire harness with, for example, twenty circuits, a production process requires twenty fold times of a working time per electric wire element. This is very inefficient in terms of production. On the other hand, if the production time and cost for a wire harness (SubAssy) are set to be constant, the working time of a single wire element a will become extremely short. This will not be practical.

Consequently, a so-called flat electric wire P' shown in FIG. 19 has been utilized. Since this wire P' is made of a plurality of single core electric wire elements a juxtaposed integrally, the elements a are not separated from each other and thus the wire is easy to handle. Further, this wire is useful since insulator displacement terminals can be connected to the wire elements at a time.

However, the electric wire P', as shown in FIG. 19, has an integrated insulator sheath for each wire element a and thus is very expensive in comparison with the same number of single core insulator-sheathed electric wire elements a. It is desirable to produce the electric wire P' (wire elements a) as inexpensively as possible since the wire harnesses are used in so many circuits.

FIG. 22 illustrates one of the methods for treating ends of a plurality of electric wire elements a at a time. This method includes the steps of: drawing wire elements a to be connected between connectors c and c from supplies S at the same time; cutting off the wire elements a by a given length by a wire-measuring device A; feeding the cut-off wire elements to termination-treating devices B, C and D; and attaching the connectors to opposite ends of the wire elements a.

In this method, a gripper g draws and feeds the juxtaposed wire elements a. However, the respective wire elements a are sometimes not drawn and fed by the same length since the respective wire elements a are not integrated and the gripper g does not apply an even clamping force to the elements a. Feeding of different lengths of the elements causes an irregular termination treatment of the elements and thus produces inferior goods. Further, when the wire elements a have different diameters, the gripper g must be changed to accord with the different diameters. This necessitates troublesome work.

In addition, since the steps of drawing the wire elements a and treating the ends of the wire elements a are effected on the same line, the producing time (tact) is affected by the slowest treatment time, for example, a treatment of inserting the terminals into the connectors. This will down an efficiency of production.

SUMMARY OF THE INVENTION

A first object of the present invention is to reduce a cost of a flat electric wire to be used for a wire harness.

A second object of the present invention is to reduce a cost of a wire harness utilizing the flat electric wire.

In order to achieve the first object, a flat electric wire for a wire harness in accordance with the present invention comprises a plurality of insulator-sheathed electric wire elements, each having a single core, juxtaposed on a plane and a plurality of reinforcing tapes stuck on the wire over the entire width at suitable portions along the length, thereby securing the electric wire elements to each other integrally.

This flat electric wire is simple and inexpensive in comparison with a conventional flat electric wire since a plurality of single core insulator-sheathed electric wire elements are integrated by the reinforcing tapes. It is possible to use an insulator-sheathed electric wire element having a small diameter (for example, 0.3 mm or less). It is also possible to produce a desired flat electric wire by readily integrating the wire elements even if the elements have different diameters.

In the flat electric wire, a discriminating mark for each electric wire element may be indicated at a position corresponding to each element on a surface of the reinforcing tape. It is possible to make a printing face relatively wide and thus discriminating marks visible since the marks are printed on the tape which integrates the electric wire elements even if they are small in diameter.

A method for producing a flat electric wire for a wire harness in accordance with the present invention, comprises the steps of: juxtaposing a plurality of insulator-sheathed electric wire elements, each having a single core, on a plane; feeding the wire elements intermittently; and applying a reinforcing tape on the juxtaposed wire elements at a desired position over the width of the elements upon stopping the elements; whereby the wire elements are secured together to each other by the tape. A discriminating mark for each electric wire element may be printed at a position corresponding to each element on a surface of the reinforcing tape.

An apparatus for producing a flat electric wire for a wire harness in accordance with the present invention, comprises: means for juxtaposing a plurality of insulator-sheathed electric wire elements on a plane, each of the elements having a single core; means for applying a reinforcing tape on the wire elements over the whole width of the juxtaposed elements in a feeding path of the elements; means for intermittently feeding the juxtaposed wire elements in the feeding path; means for accumulating the juxtaposed wire elements in a forward part in the feeding path; and a reel for taking up the juxtaposed wire elements.

The accumulating means in the flat electric wire producing apparatus assure to supply the wire elements to the taking-up reel during the stopping of the feeding means. Consequently, the taking-up reel can rotate continuously at a constant speed to take up the flat electric wire.

In order to achieve the second object, a method for producing a wire harness in accordance with the present invention, comprises the steps of: winding a flat electric wire for a wire harness on a reel beforehand, the electric wire including a plurality of insulator-sheathed electric wire elements, each having a single core, juxtaposed on plane and a plurality of reinforcing tapes stuck on the wire over the whole width at suitable portions along the length; drawing the flat electric wire from the reel; measuring and cutting off the flat electric wire; carrying the cut-off flat electric wire in a juxtaposed direction while holding opposite ends of the cut-off flat electric wire; and treating at least one end of the cut-off flat electric wire during the carrying step.

Since the producing line of the flat electric wire is isolated from the termination treatment line of the electric wire elements, any troubles caused in one of both lines do not bring an influence into the other line and each line can operate the respective steps by one's own producing tack or pace. Further, the flat electric wire is integrated by the reinforcing tape, the whole flat electric wire can be displaced in the line, even if it is fed by a partial clamp and in particular the juxtaposed wire elements have different diameters. The trailing end of the reinforcing tape may engage with a protrusion on a clamping surface of a damper upon clamping and drawing the tape.

When the damper pinches the electric wire, the pinched portion of the wire is firmly secured since the reinforcing tape holds the juxtaposed electric wire elements together and the clamping surface of the damper is relatively flat. When the trailing end of the reinforcing tape engages with the protrusion on the clamping surface of the clamper, the damper can draw the wire elements while the protrusion pushes the reinforcing tape, thereby assuring to clamp and draw the elements.

An apparatus for producing a wire harness in which connectors are attached to opposite ends of a flat electric wire, the wire including a plurality of insulator-sheathed electric wire elements, each having a single core, juxtaposed on a plane and a plurality of reinforcing tapes stuck on the wire over the whole width at suitable portions along the length, and in which a terminal connected to an end of each of the wire elements of the flat electric wire is inserted in the connector, comprises: an inserting device which selects terminals to be inserted into the connector in order, cuts off the selected terminals from terminal reels, and inserts the selected terminals into a temporary terminal holder adapted to hold the terminals to be inserted into the connector; a connecting device which draws, measures and cuts off the flat electric wire, and connects each terminal inserted in the temporary terminal holder to opposite ends of each wire element of the cut-off flat electric wire at the same time; and a terminal inserting device which extracts the terminals connected to opposite ends of the wire elements from the holder at the same time or at a time and inserts the extracted terminals into the connector. Accordingly, the step for connecting the terminals to the wire elements can be carried out in the lump and the total ability of production can be enhanced by preparing the necessary devices in accordance with the connecting devices which enhances an ability of processing per flat electric wire.

It is possible to do away with a rest device and to enhance an efficiency of production by carrying out individually the steps of inserting the terminals into the temporary terminal holder, connecting all terminals to the wire elements at a time and inserting the terminals into the connector and by determining the number of the individual device and balancing the tacts of the devices in accordance with the tacts of the respective steps.

In the apparatus for producing the wire harness, a number of temporary terminal holders are contained in a magazine and the magazine carries the terminals to the devices, respectively.

Thus, the magazine can carry the terminals easily.

DETAILED DESCRIPTION OF THE PREFERRED EMBODIMENTS

Figure 1:
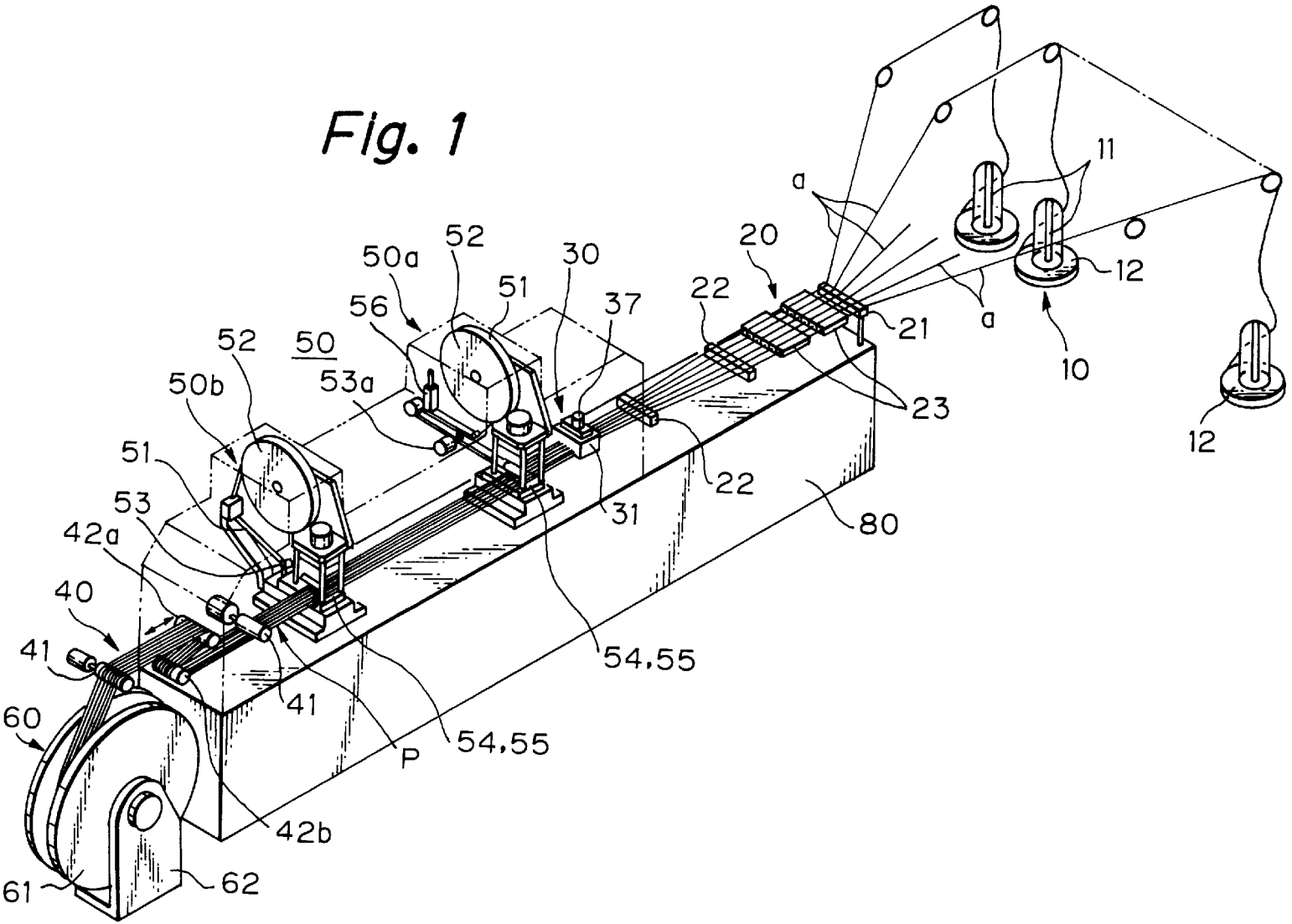
FIG. 1 is a perspective view of an embodiment of an apparatus for producing a flat electric wire for a wire harness in accordance with the present invention.

FIGS. 1 to 5 show an embodiment of an apparatus for producing a flat electric wire for a wire harness in accordance with the present invention. This apparatus includes a station 10 for supplying a plurality of insulator-sheathed electric wire elements a, each having a single core, a station 20 for straightening the twisted wire elements a, a station 30 for clamping the juxtaposed wire elements a, a station 50 for applying a reinforcing tape 51 to the juxtaposed wire elements a, a station 40 for feeding and accumulating the wire elements a, and a station 60 for taking up the wire elements a. The station 20 exclusive of the supplying station 10 and taking-up station 60 is provided on a bed 80.

The supplying station 10 includes a plurality of supply stands 11, each of which receives a coil 12 of the electric wire element a. Each wire element a is drawn out of the coil 12 on the supply stand 11. The number of supply stands 11 depends on the number of the electric wire elements a for a flat electric wire P to be produced. For example, if the flat electric wire P needs ten electric wire elements a, ten supply stands 11 are provided. In the shown embodiment, six supply stands 11 are arranged, since six wire elements a constitute the flat electric wire P.

The straightening station 20 includes wire element guides 21, 22, each of which is provided on the front and rear sides with juxtaposed pins. The front side guide 21 serves to separate the wire elements a from the supply stands 11 at a given distance from each other. On the other hand, the rear side guide 22 serves to adjust a distance between the wire elements a, which are straighten by the straightening device 23 to eliminate a torsion in each wire element a, to accord with the distance between the electric wire elements a in the electric wire P.

Figure 5:
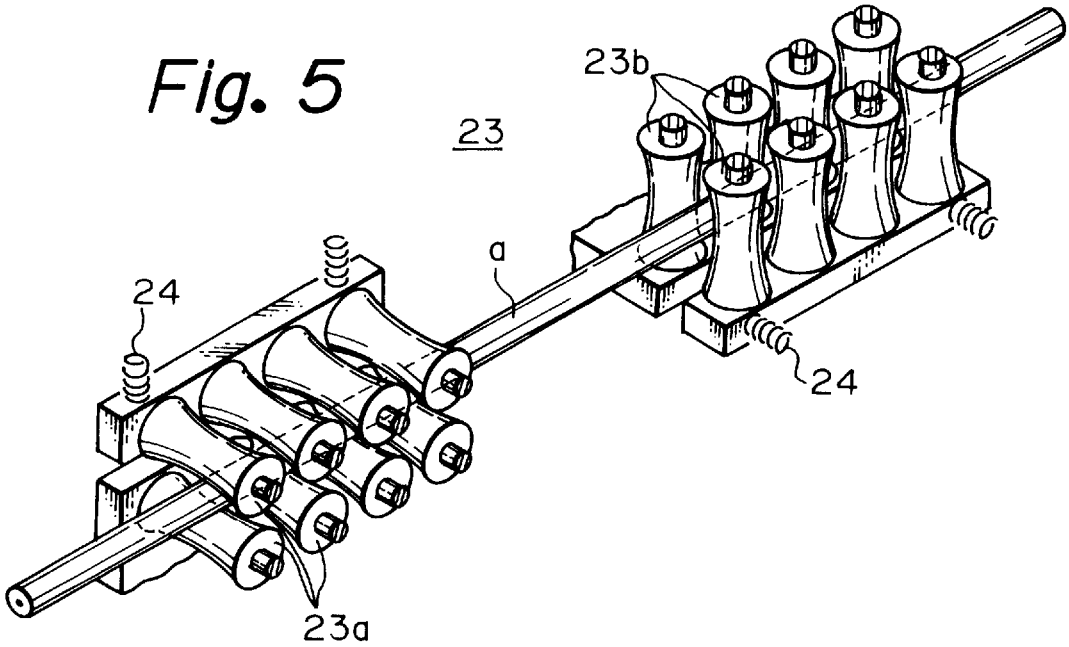
FIG. 5 is a perspective view of a straightening device in FIG. 1.

The straightening device 23 includes, as shown in FIG. 1, two sets of front and rear side rollers for each wire element a. As shown in FIG. 5 in more detail, the straightening device 23 includes a set of front side guide rollers 23*b* which clamp opposite side surfaces of the wire element a and a set of rear side guide rollers 23*a* which clamp the upper and lower surfaces of the wire element a. One of the two sets of rollers 23*a* and 23*b* is biased by spring 24 so that the rollers 23*a* and 23*b* can straighten the twisted wire element a by means of rolling.

Figure 4A:
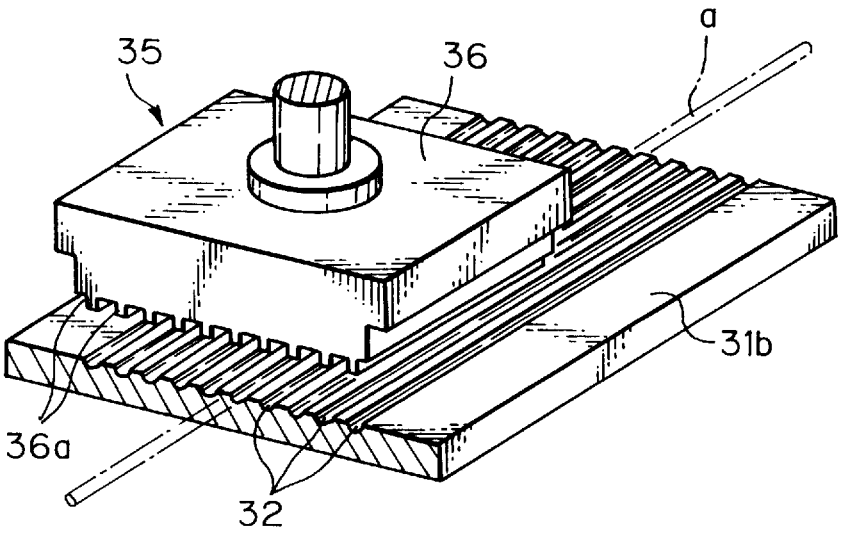
FIG. 4 shows a wire clamping station in FIG. 1, FIG. 4(*a*) being a perspective view of a main part of the station and FIG. 4(*b*) being a front elevational view of the station.
Figure 4B:
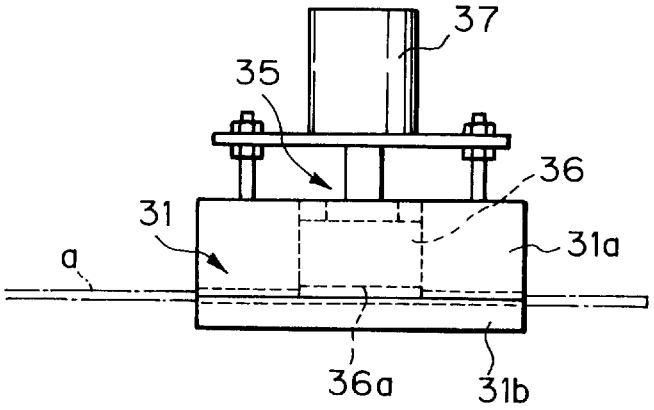

As shown in FIG. 1, FIGS. 4(*a*) and 4(*b*), the clamping station 30 for the wire elements a includes a grooved guide 31 and a gripper 35 which presses and stops the wire elements a passing through the grooved guide 31. The grooved guide 31 includes a pair of upper and lower members 31*a* and 31*b* each of which is provided with grooves 32 extending longitudinally. Each wire element a from the guide 22 is guided in each groove 32.

The gripper 35, as shown in FIGS. 4(*a*) and 4(*b*), includes a press table 36 and an air cylinder 37 for actuating the press table 36. The press table 36 is provided on the bottom surface with a plurality of press ridges 36*a* each of which enters each groove 32 in the lower member 31*b*. When the air cylinder 37 moves the press table 36 downward, each press ridge 36*a* pushes each wire element a in each groove 32 to grip it. When the press table 36 moves upward, the wire elements a cannot move longitudinally in the grooves 32 on account of a frictional resistance, although the wire elements a are free in the grooves 32.

Figure 2:
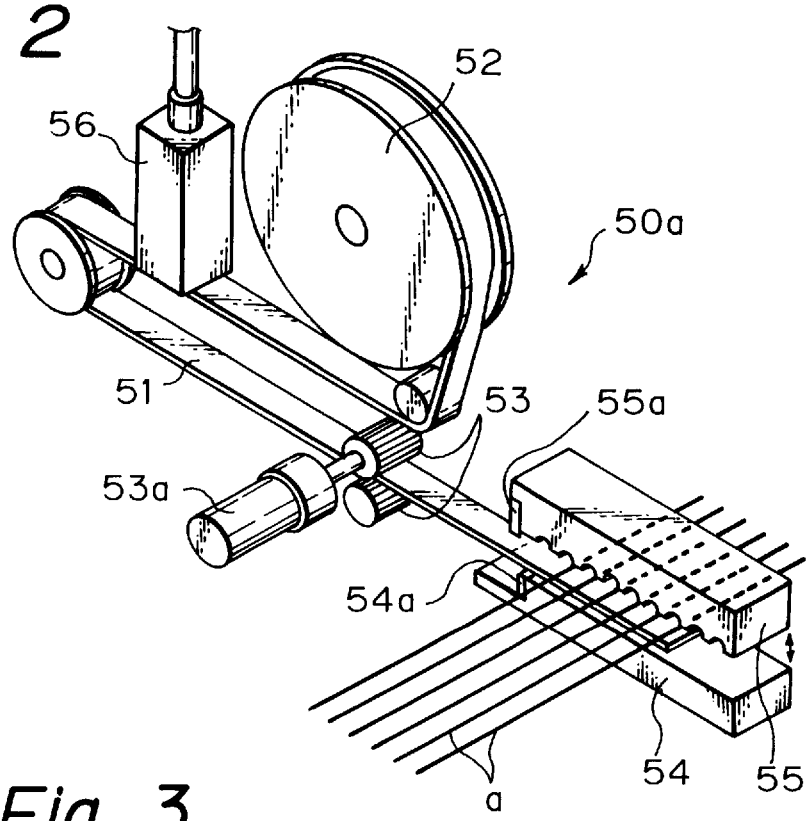
FIG. 2 is an enlarged perspective view of a main part of a reinforcing tape applying station in the embodiment shown in FIG. 1.
Figure 3:
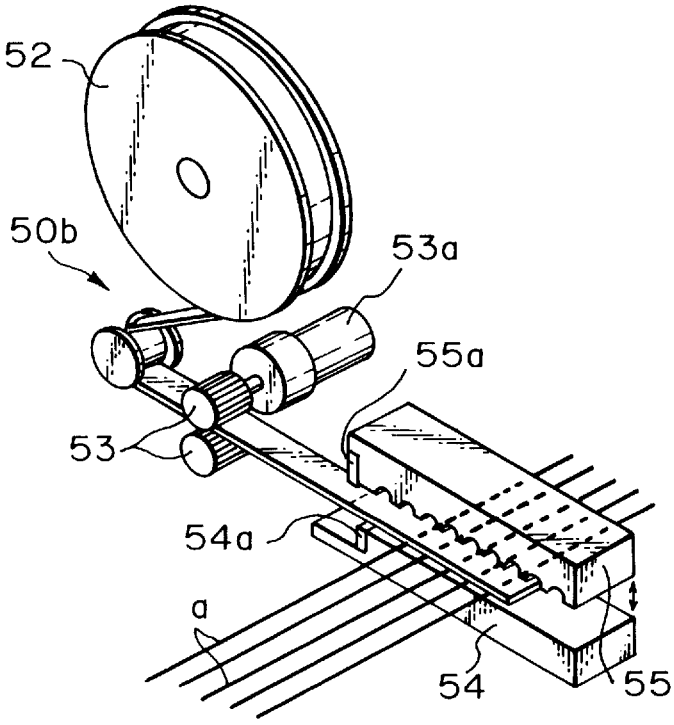
FIG. 3 is an enlarged perspective view of a main part of a reinforcing tape applying station in the embodiment shown in FIG. 1.

The reinforcing tape applying station 50, as shown in FIGS. 1 to 3, includes a pair of front and rear side applying devices 50*a* and 50*b*. The front side applying device 50*a* includes a pair of pinch rollers 53, 53 which serve to feed the reinforcing tape 51 from a reel 52, an injection type printer 56 which serves to print a discriminating mark b (see FIG. 6(*a*)) on the reinforcing tape 51 during feeding, and a pair of upper and lower welding blocks 54 and 55 which serve to weld the reinforcing tape 51 onto the wire elements and to cut the tape 51. Rotation of the pinch rollers 53, 53 feeds the reinforcing tape 51 from the reel 52. After the printer 56 prints the discriminating mark b (for example, 123, 456, . . . ) on the surface of the reinforcing tape 51, the tap is further fed below the wire elements a and in a direction perpendicular to a feeding direction of the wire elements a. The feeding amount of the tape is controlled by a number of revolutions of a motor 53*a* of the pinch rollers 53, 53. Each discriminating mark corresponds to each wire element a. The discriminating mark may be any indicia such as colors, letters, numerals and so on.

The lower welding block 54 is fixed on the bed 80 while the upper welding block 55 is movably supported on the bed 80. The upper welding block 55 is normally disposed to an upper position. When the block 55 descends to a lower position, the block 55 presses the wire elements a and reinforcing tape 51 onto the lower welding block 54, thereby welding the tape 51 onto the wire elements a and cutting off the tape 51 by the cutter blades 54*a* and 55*a*. Consequently, the flat electric wire P shown in FIG. 6(*a*) is obtained (The applying device 50*a* applies the tape 51 on the wire elements a at the rear side, as shown in FIG. 2).

The rear side applying device 50*b* has no printer 56 in this embodiment since the discriminating mark b may be printed on either surface of the reinforcing tape 51, although the rear side applying device 50*b* may be the same as the front side applying device 50*a*. The rear side applying device 50*b* applies the reinforcing tape 51 on the surface of the flat electric wire P (rear side in FIGS. 6(*a*) and 6(*b*)) in the same manner as the front side applying device 50*a*. It is possible to actuate both applying devices 50*a* and 50*b* at the same time by according the distance between both devices 50*a* and 50*b* to the distance of the reinforcing tapes 51 to be applied on the wire P. Preferably, the distance between both devices 50*a* and 50*b* may be adjusted by sliding one of them on the bed 80. In the present invention, one of the applying devices 50*a* and 50*b* may be omitted.

Figure 6A:
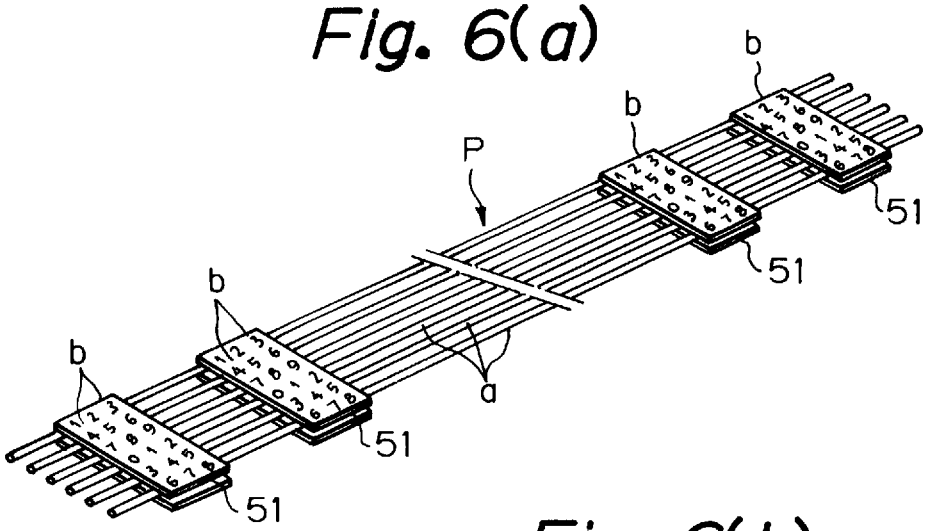
FIG. 6 shows an embodiment of a flat electric wire in accordance with the present invention, FIG. 6(*a*) being a partially removed perspective view of the flat electric wire and FIG. 6(*b*) being a cross sectional view of the flat electric wire on which a reinforcing tape is applied.
Figure 6B:
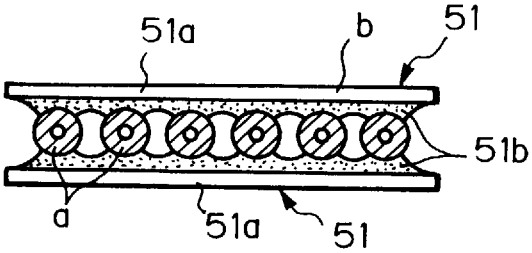

The reinforcing tape 51, as shown in FIG. 6(*b*), is produced, for example, by coating a base film 51*a* made of polyethylene terephthalate (PETP) with polyvinyl chloride (PVC) base resin 51*b*. When heated tape 51 is pressed on the wire elements a, melted resin 51*b* is naturally welded on the insulator sheath of the wire element a since the sheath is usually made of PVC, thereby firmly welding the reinforcing tape 51 on the wire elements a. The reinforcing tape 51 may be a well-known adhesive tape as well as the welding tape.

The feeding and accumulating station 40 includes feeding rollers 41 and accumulating rollers 42*a* and 42*b*. The wire elements a (flat electric wire P) are juxtaposed and fed at a given speed by the feeding rollers 41. Forward and backward movement of one accumulating roller 42*a* absorbs a difference between a feeding length of the flat electric wire P from the reinforcing tape applying station 50 and that from the rear side feeding roller 41. That is, the wire elements a are temporarily or intermittently stopped at the time of applying the reinforcing tape 51, as described hereinafter. The accumulating rollers 42*a* and 42*b* absorb the stationary tape 51 and thus the rear side feeding roller 41 continues to feed the tape 51.

The taking-up station 60 includes a reel 61 and a stand 62. The reel 61 takes up the flat electric wire P from the feeding roller 41. The feeding length of the wire elements a is absorbed by the accumulating rollers 42*a* and 42*b* upon exchange of the reel 61.

Next, an operation of this embodiment will be described. White single core insulator-sheathed electric wire elements a (0.3 mm in diameter) are led from supply stands 11 to the taking-up reel 61 and is fed at a given speed by the feeding roller 41. When the feeding length of the wire elements a reaches a necessary distance between the reinforcing tapes 51, the gripper 35 clamps and stops the wire elements a. The applying devices 50*a* and 50*b* apply the reinforcing tapes 51 on the front and rear sides of the wire elements during the stopping of elements, thereby producing the flat electric wire P, as shown in FIG. 6. The front side feeding roller 41 is brought into slipping or stopping upon the stopping of elements.

The electric wire elements a are fed from the supply stands 11 intermittently and the reinforcing tape 51 with the discriminating mark b is applied to the juxtaposed electric wire elements a to form the flat electric wire P. The flat electric wire P is taken up on the reel 61.

Figure 7:
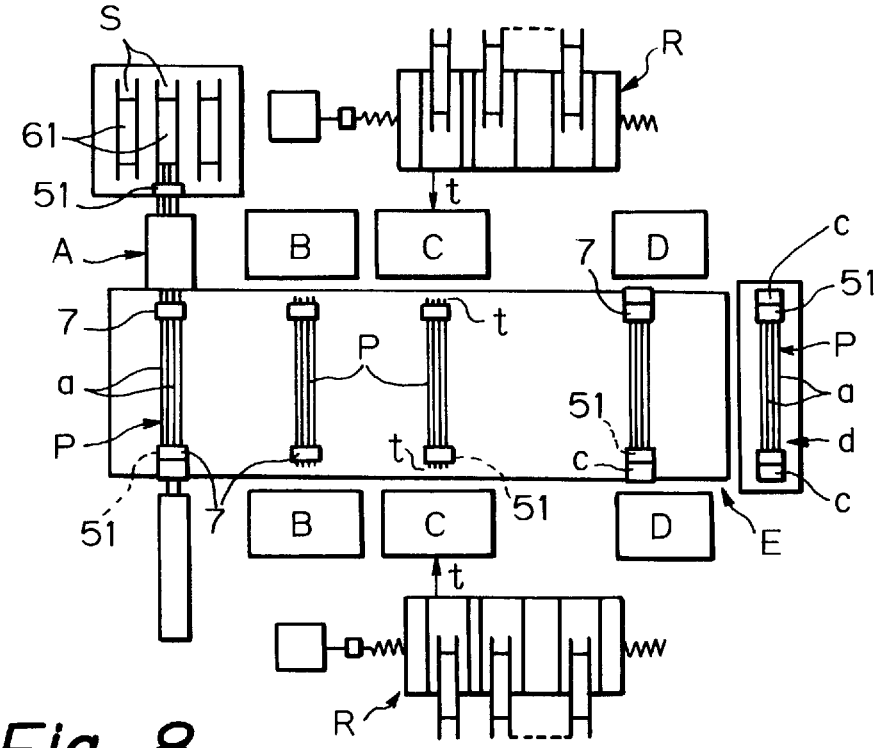
FIG. 7 is a plan view of an embodiment of an apparatus for producing a wire harness which utilizes the flat electric wire of the present invention.

Next, an apparatus for producing a wire harness (SubAssy) W from the flat electric wire P formed by the producing apparatus mentioned above will be explained below by referring to FIGS. 7 to 11. As shown in FIG. 7, the taking-up reel 61 is mounted on the wire supply S and the flat electric wire P is drawn from the reel 61 and is cut off by a given length by means of the measuring and cutting apparatus A. Various kinds of the flat electric wires P with different diameters of the wire elements a are mounted on the supplies S. The measuring and cutting device A can draw any flat electric wire P out of the supplies S.

Figure 8:
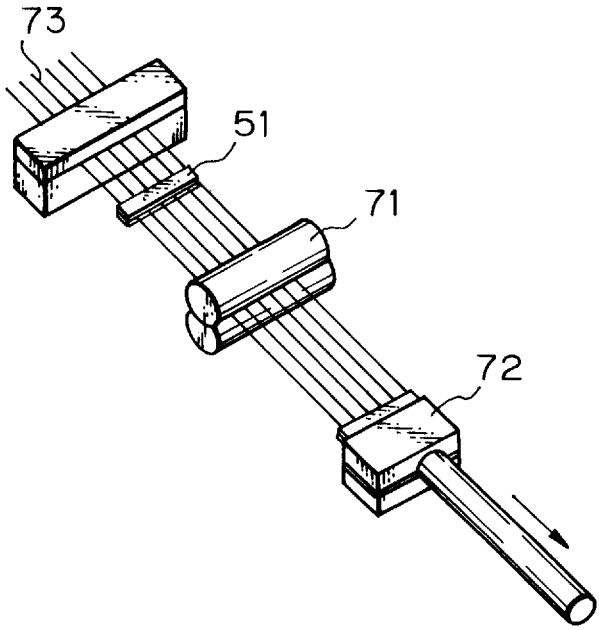
FIG. 8 is a perspective view of an embodiment of a wire-drawing, measuring and cutting device in the apparatus shown in FIG. 7.
Figure 9:
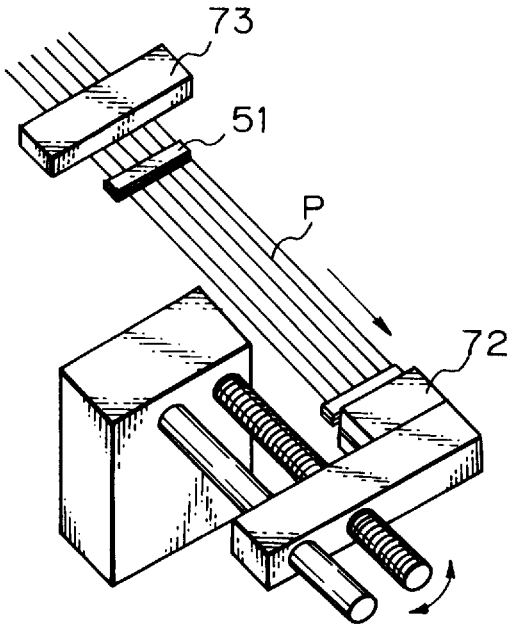
FIG. 9 is a perspective view of another embodiment of the wire-drawing, measuring and cutting device in the apparatus shown in FIG. 7.

The measuring and cutting device A feeds the selected electric wire P by a pair of feeding rollers (measuring rollers) 71 shown in FIG. 8, clamps the leading 30 end of the wire P by a pair of drawing hands (clampers) 72, and cuts off the wire P at a given position by a pair of cutters 73. As shown in FIG. 9, only the drawing hands 72 can draw and measure the wire P.

Figure 10A:
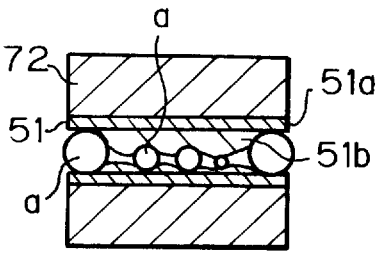
FIG. 10 is an explanatory view of an operation of drawing hands, FIG. 10(*a*) being a cross sectional view of drawing hands and FIG. 10(*b*) being a longitudinal sectional view of drawing hands.
Figure 10B:
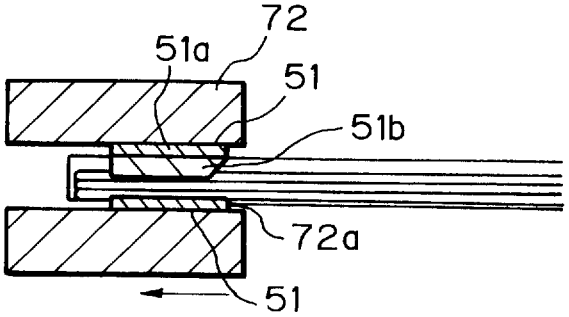

When the drawing hands 72 clamp the flat electric wire P, a resin (adhesive) 51*b* on the reinforcing tape 51 enters clearances between the wire elements a to make the surface of the reinforcing tape 51 relatively flat, as shown in FIGS. 10(*a*) and 10(*b*). Consequently, when the drawing hands 72 clamp the reinforcing tape 51, the hands bite the wire P firmly and can draw it smoothly.

Figure 11A:
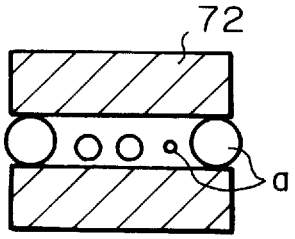
FIG. 11 is an explanatory view of an operation of another drawing hands, FIG. 11(*a*) being a cross sectional view of drawing hands and FIG. 11(*b*) being a longitudinal sectional view of drawing hands.
Figure 11B:
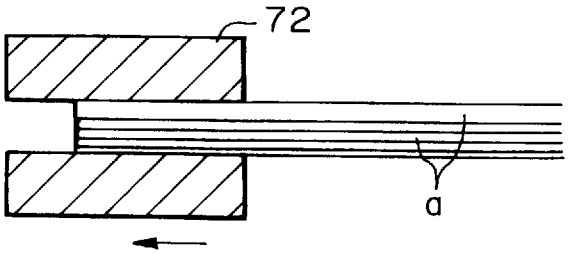

As shown in FIG. 10(*b*), the drawing of the wire P can be more firmly effected by engaging a protrusion 72*a* with the trailing end of the reinforcing tape 51. The above-mentioned operations can be carried out even if the diameters of the wire elements a are different. For example, as shown in FIGS. 11(*a*) and 11(*b*), if the hands 72 clamp the flat electric wire P at a portion exclusive of the reinforcing tape 51, the clamping force cannot be applied uniformly to the respective wire elements a on account of a difference between the diameters of the elements a. Consequently, it will be difficult to smoothly draw the wire P.

Figure 16:
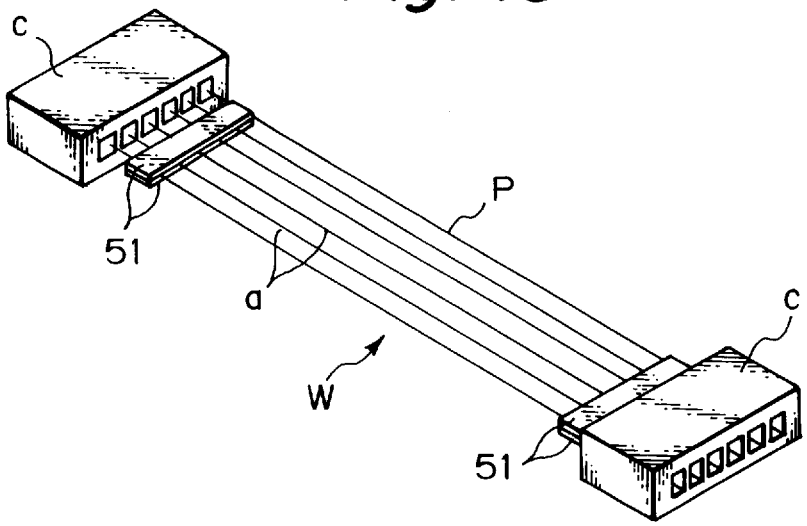
FIG. 16 is a perspective view of a typical wire harness.

The measured and cut-off flat electric wire p is clamped by chucks 7 at opposite ends and fed to a stripping device B, a terminal-connecting device C, and a connector-attaching device D in order. In the stripping device B the insulator sheath at opposite ends of each electric wire element a in the flat electric wire P is removed at a time, in the terminal-connecting device C terminals t from a terminal reel R are connected to the stripped ends of the wire elements a at a time, and in the connector-attaching device D, as shown in FIG. 16, connectors C which accords with each end of the elements a are attached to opposite ends of the wire P. The flat electric wire P with the connectors C, or wire harness W is taken out of the line as a product d (FIG. 7).

Figure 12:
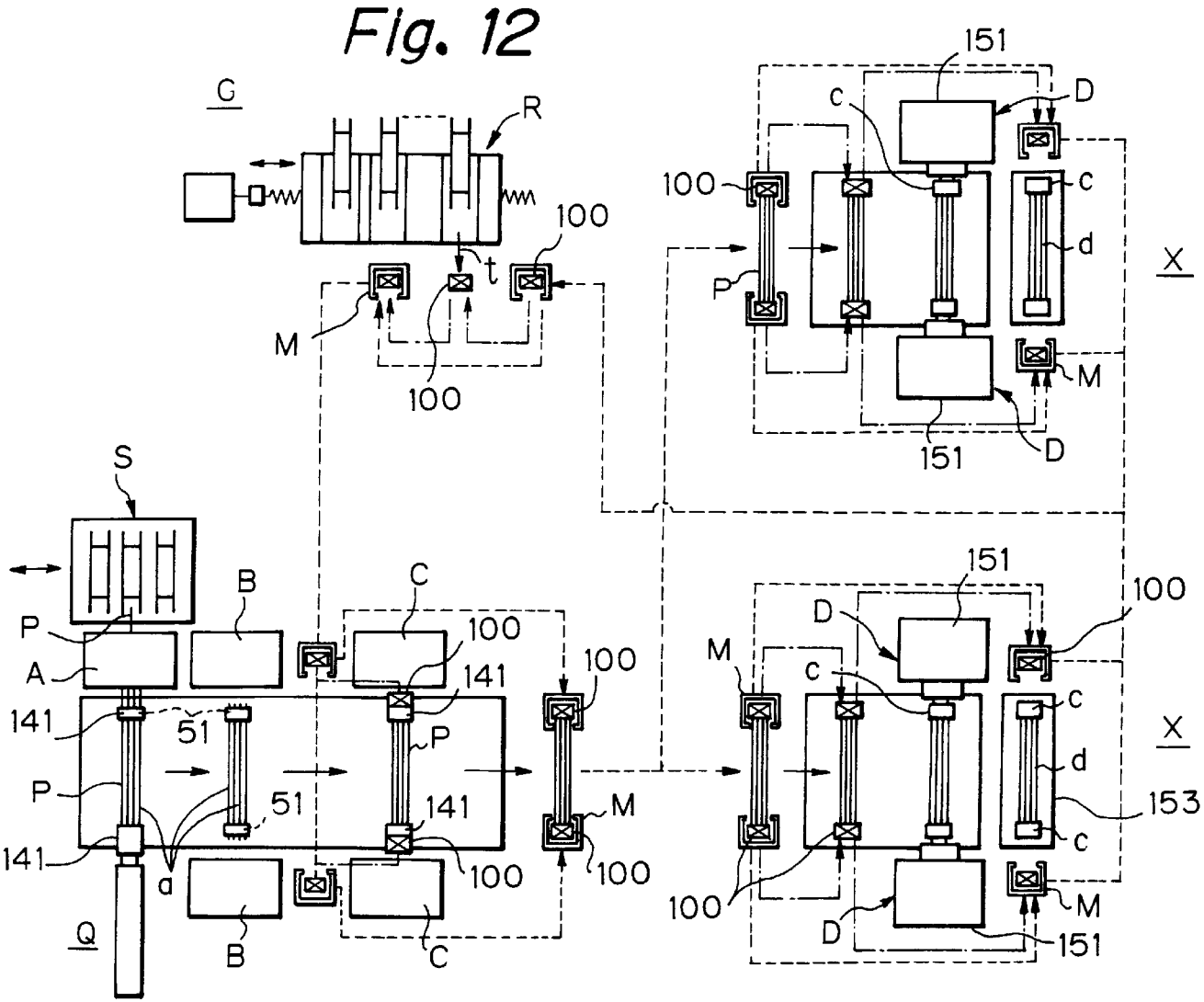
FIG. 12 is a plan view of another embodiment of the apparatus for producing the wire harness which utilizes the flat electric wire of the present invention.

An embodiment of the apparatus of the present invention shown in FIGS. 12 to 15 enhances an efficiency of production in consideration of a termination treatment tact of the flat electric wire P. FIG. 12 shows a schematic construction of this embodiment. The apparatus comprises: a dummy housing 100 which serves as a temporary terminal holder which holds terminals t to be inserted into a connector c; an inserting device G which selects terminals t to be inserted into the connector c in order, cuts off the selected terminals t from terminal reels R, and inserts the selected terminals t into the dummy housing 100; a connecting device Q which draws, measures, and cuts off the flat electric wire P from the wire supply S, strips an insulator sheath at opposite ends of each wire element a in the flat electric wire P, and connects each terminal t inserted in the dummy housing 100 to opposite ends of each element a at a time; and a terminal-inserting device X which extracts the terminals t connected to opposite ends of the wire elements a from the dummy housing 100 at a time or one by one and inserts the extracted terminals t into the connectors c.

The numbers of these devices G, Q and X are determined in accordance with a production tact. This embodiment includes one inserting device G, one connecting device Q, and two terminal-inserting devices X.

Figure 13A:
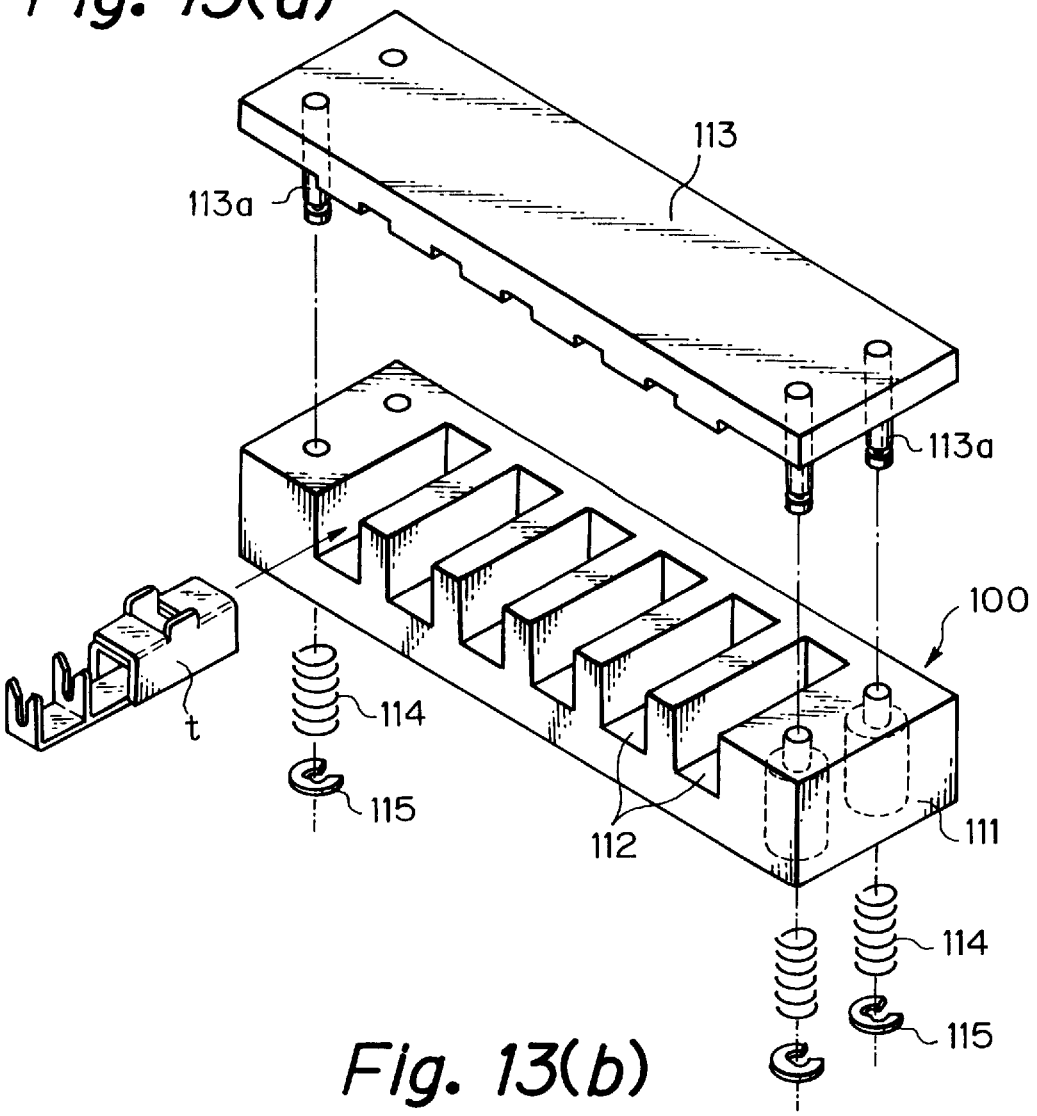
FIG. 13 shows an embodiment of a temporary terminal holder (dummy housing), FIG. 13(*a*) being an exploded perspective view of the holder and FIG. 13(*b*) being a cross sectional view of the holder.
Figure 13B:
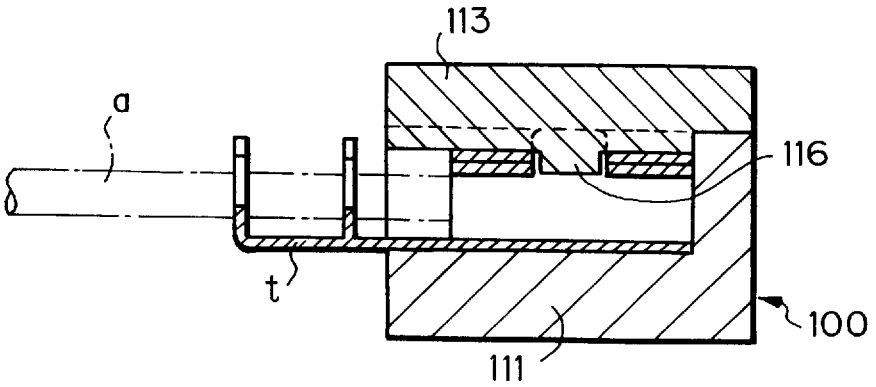

The dummy housing 100 which serves as a temporary terminal holder, as shown in FIGS. 13(*a*) and 13(*b*), is provided in its body 111 with terminal-receiving grooves 112 each formed into a head shape of the terminal t and a lid 113 which cover the upper open portions of the grooves 112. The number of the grooves 112 is optional. The lid 113 is provided on its opposite ends with legs 113*a* which pass through the body 111. Latch rings 115 are fitted through coil springs 114 on the distal ends of the legs 113*a*, thereby preventing the legs from coming out of the body 111. The lid 113 is pressed on the body 111 by means of the coil springs 114. As shown in FIG. 13(*b*), a projection 116 on the rear surface of the lid 113 engages with a hole in the terminal t, thereby holding it in the groove 112. When the distal ends of the legs 113*a* are pushed, the lid 113 is moved away from the body 111 and the projection 116 comes out of the hole in the terminal t. Then, the terminal t can be detached from the housing 100.

Figure 14A:
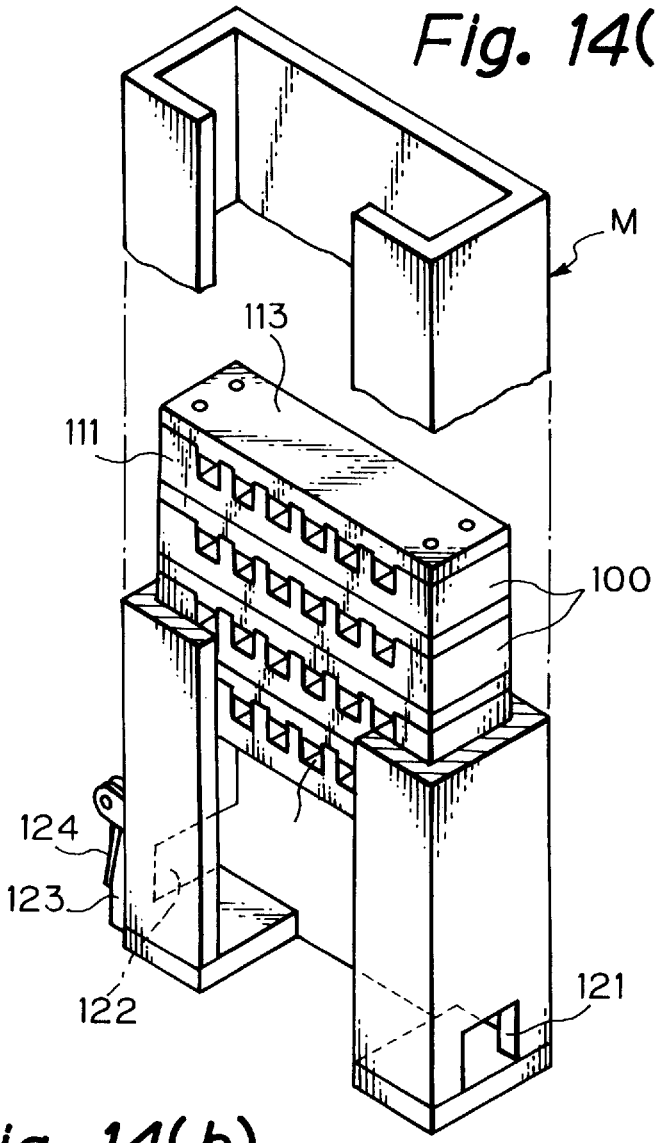
FIG. 14 shows an embodiment of a magazine, FIG. 14(*a*) being a partially removed perspective view of the magazine and FIG. 14(*b*) being a cross sectional view of a main part of the magazine.
Figure 14B:
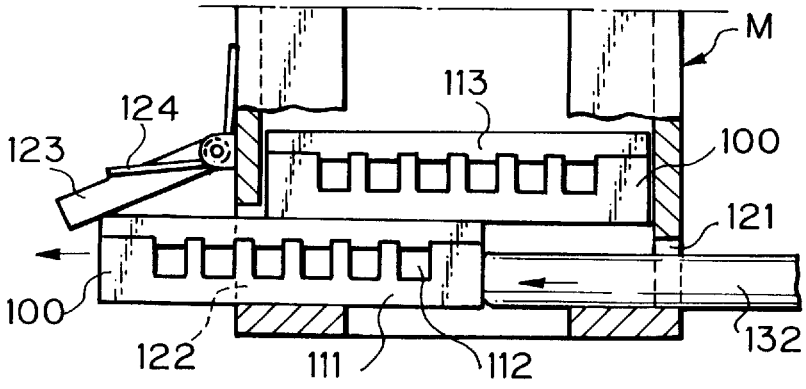

The dummy housing 100 is inserted in a magazine M shown in FIGS. 14(*a*) and 14(*b*) at a time from the upper part. The magazine M is carried to the respective devices manually or by a robot. The magazine M is formed into a ox like shape having a U-cross section. The magazine M is provided in its lower portion with an opening 121 adapted to push the dummy housing 100 and an opening 122 opposed to the opening 121 and adapted to pass the housing 100. A lid 123 is attached to the opening 122 rotatably. The lid 123 closes the opening 122 normally by means of a spring 124. The dummy housing 100 can pass through the opening 122 while rocking up the lid 123 against the spring 124, as shown in FIG. 14(*b*).

Figure 15A:
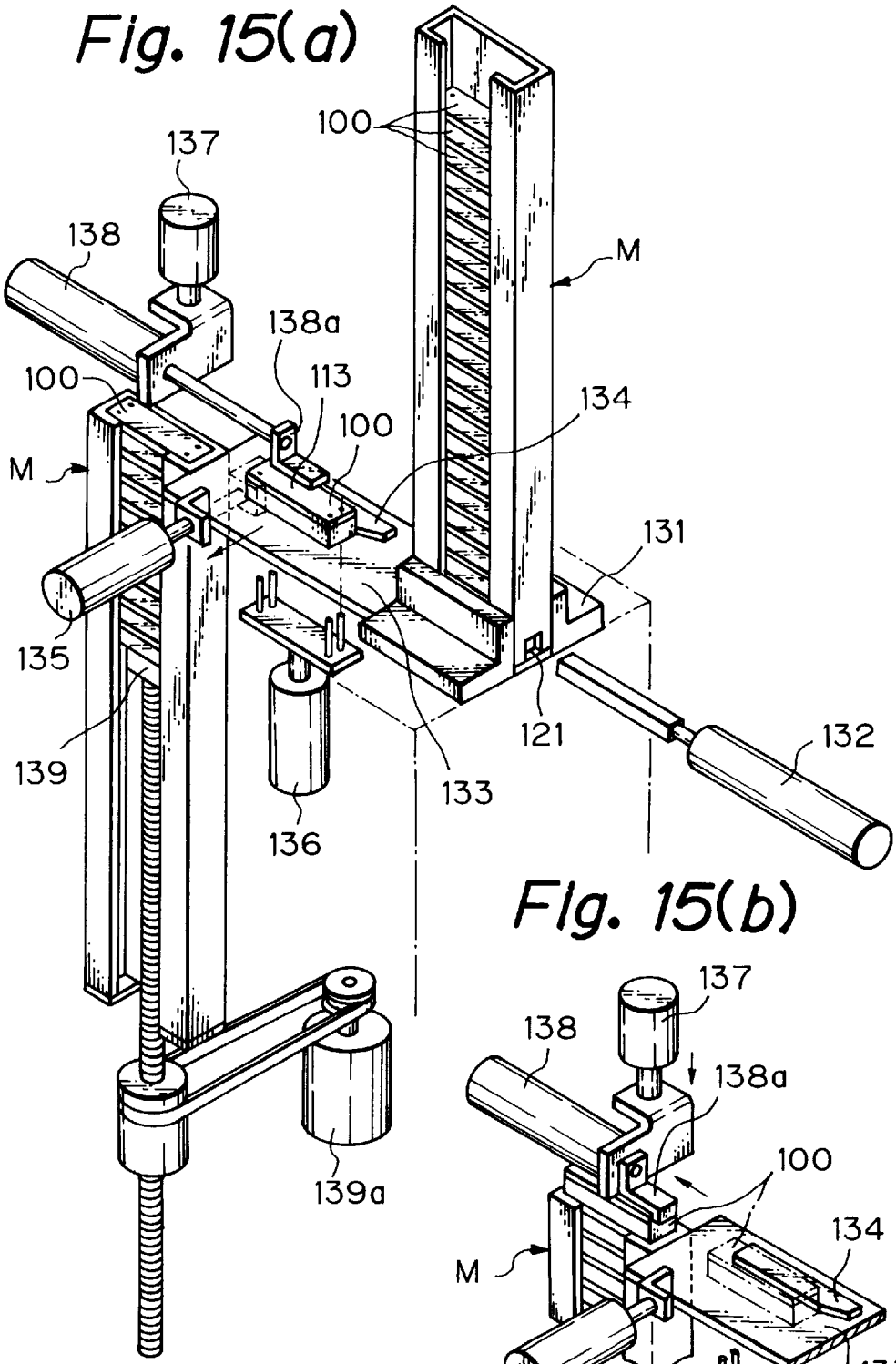
FIG. 15 shows an embodiment of a magazine feeding and receiving mechanism, FIG. 15(*a*) being a perspective view of the whole mechanism and FIG. 15(*b*) being an enlarged perspective view of a part of the mechanism.
Figure 15B:
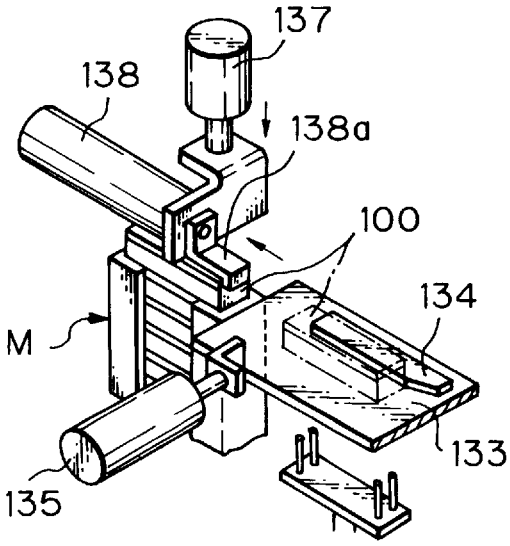

The inserting device G has a feeding and receiving mechanism, as shown in FIGS. 15(*a*) and 15(*b*). The magazine M is mounted in a feeding block 131. When a piston rod of an air cylinder 132 pushes the lowest housing 100 in the magazine M through the opening 121, the lowest housing 100 is extruded out of the magazine M onto a terminal-inserting table 133 through the opening 122 in order. The extruded dummy housing 100 is positioned by a positioning block 134 and a positioning air cylinder 135 and at this position the terminals are selected in accordance with the order to be inserted into the connector c by means of an NC device. Then, the selected terminal t is cut off from the terminal reel R and inserted into the dummy housing 100. At this time, the lid 113 is raised by an air cylinder 136.

After all terminals t have been inserted into the grooves 112, the air cylinder 136 retracts its piston rod to close the lid 113. After the positioning air cylinder 135 has retracted its piston rod, an air cylinder 137 fixed vertically on a frame extrudes its piston rod and an air cylinder 138 fixed horizontally through a bracket to the piston rod of the air cylinder 137 extrudes an arm 138*a*, as shown in FIG. 15(*b*). When the air cylinder 138 retracts the arm 138*a*, the dummy housing 100 is received in a containing magazine M. A containing block 139 which is moved up and down through a screw shaft by a servo motor 139*a* is inserted in a lower part of the magazine M. When the block 139 descends by a distance corresponding to a thickness of the dummy housing 100, the dummy housing 100 is contained in the magazine M at a time. When the magazine M is empty or full of the dummy housings 100, the magazine M is exchanged for a new one. A new magazine M which is full of the dummy housings 100 is carried to the terminal-connecting device C in the connecting device Q. Carrying paths of the magazine M and moving paths of the dummy housing 100 are shown by broken lines and one-dot chain lines in FIG. 12.

In the connecting device Q, the flat electric wire P corresponding to each terminal t in the dummy housing 100 is drawn from the respective wire supplies S by the NC device, the wire P is measured and cut off by the measuring and cutting device A, and the cut-off wire P, which includes the wire elements a corresponding to the terminals t in the dummy housing 100, is fed to the treating device B and the connecting device C by chucks 141. The treating device B strips the insulator sheath of the wire element a, if necessary for welding. The connecting device C connects each wire element a in the flat electric wire P to each terminal t in each dummy housing 100 at a time by pressing or welding and feeds out them. At this time, the step of moving the dummy housing 100 from the supplying magazine M to the receiving magazine M is effected in the same manner as that of the inserting device X. That is, a lump connection between the terminals t and the wire elements a is carried out on the terminal-inserting table 133. At this time, the lid 113 is not raised. The magazine M which is filled with the dummy housing 100 is carried to the inserting device X to insert the terminals t into the next connector c while connecting the electric wire P (wire elements a) between the opposed magazines M.

In the inserting device X, the respective magazines M kick out the dummy housings 100, the electric wires P in the dummy housings 100 are extracted at a time or one by one, and they are inserted into the cavities in the connector c which are supplied from a feeder 151 individually. After inserting (attaching to the connectors c), the empty dummy housing 100 is contained in another magazine M and a product d in which the wire elements a are attached to the connectors c at opposite ends is contained in a stocker 153. The magazine M which is filled with the empty dummy housings 100 is returned to the terminal-inserting device G while the empty magazine M is moved to a rear part of the inserting device X. The respective dummy housings 100 and magazines M are moved by robots not shown.

Figure 17:
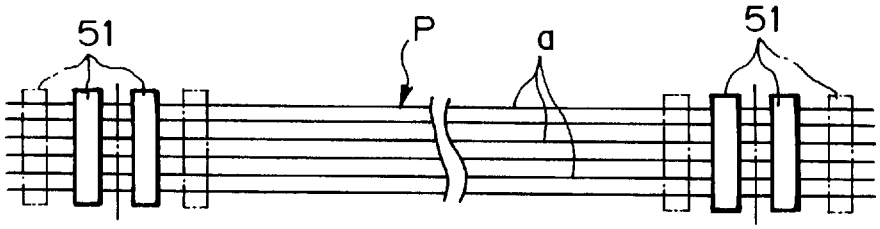
FIG. 17 is an explanatory view illustrating a position of applying the reinforcing tape for the flat electric wire and an operation of termination treatment.
Figure 18A:
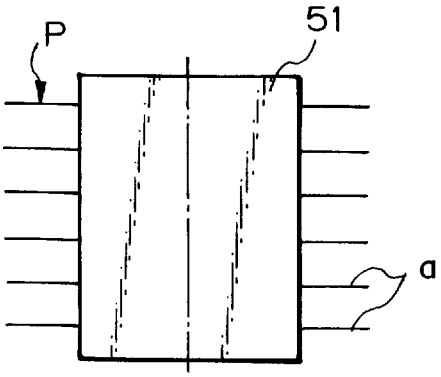
FIGS. 18(*a*) and 18(*b*) are explanatory views illustrating the position of applying the reinforcing tape and the operation of termination treatment.
Figure 18B:
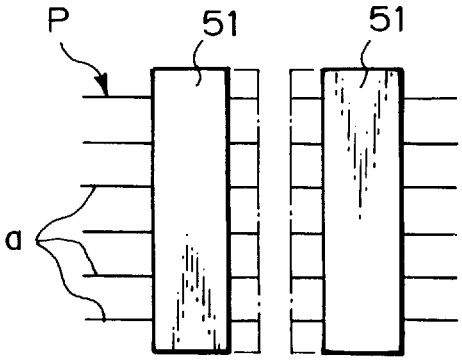
Figure 19:
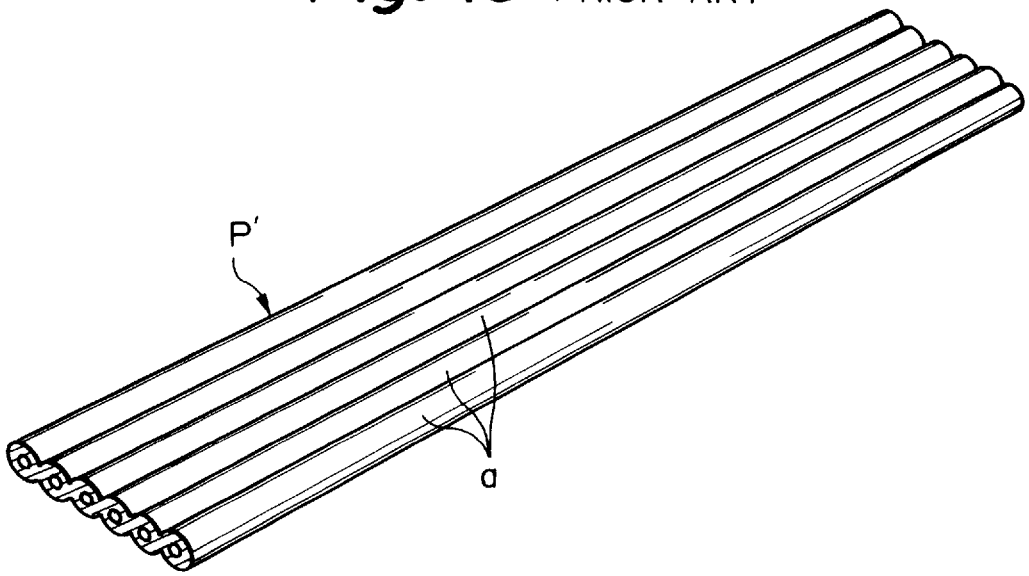
Fig. 19 PRIOR ART
FIG. 19 is a perspective view of a conventional flat electric wire.
Figure 20:
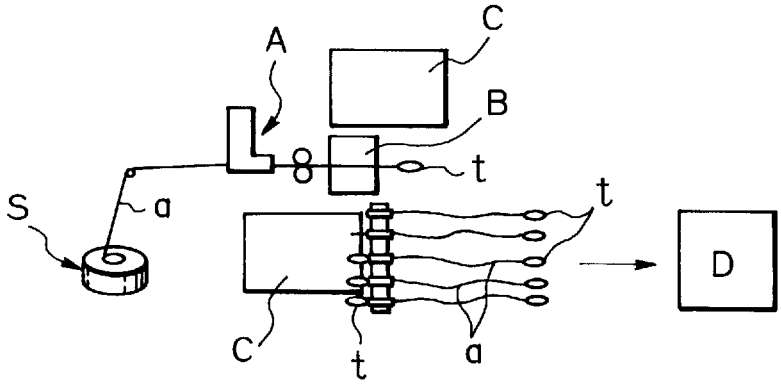
Fig. 20 PRIOR ART
FIG. 20 is a schematic view illustrating a conventional apparatus for producing a wire harness.
Figure 21:
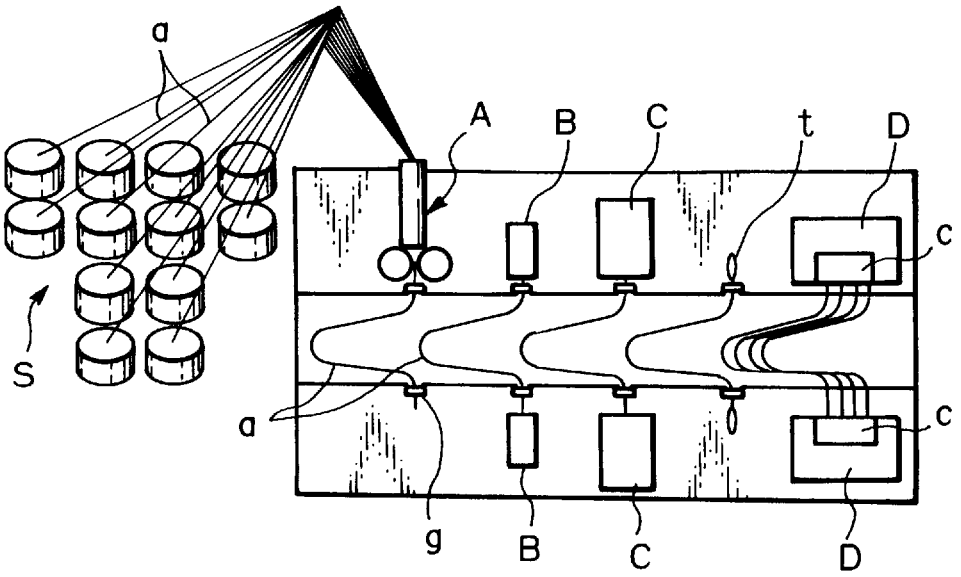
Fig. 21 PRIOR ART
FIG. 21 is a schematic view illustrating another conventional apparatus for producing a wire harness.
Figure 22:
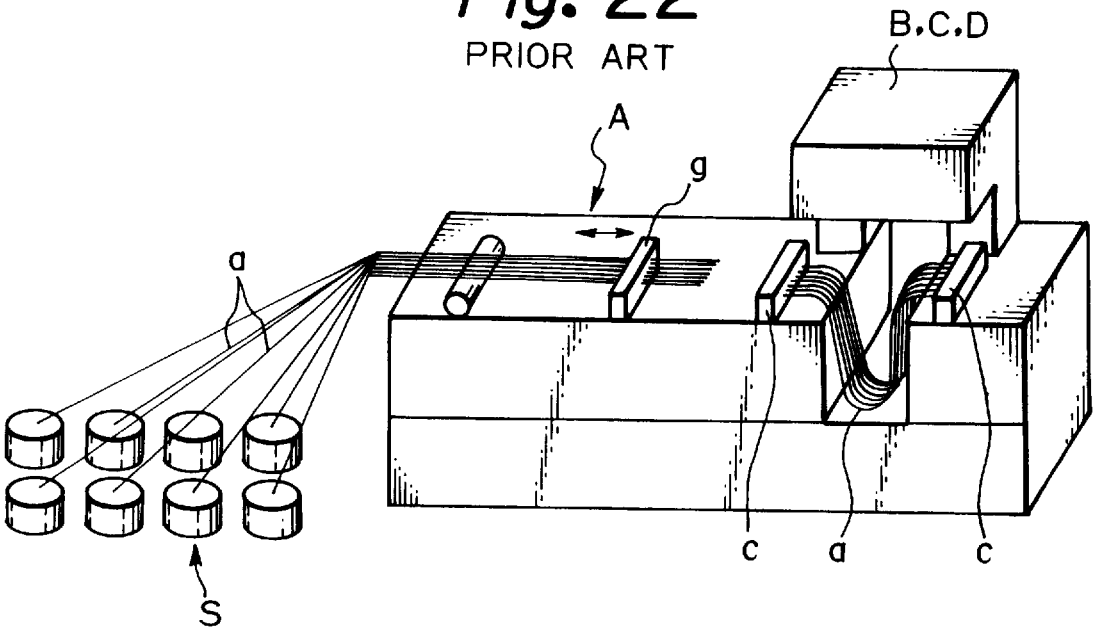
Fig. 22 PRIOR ART
FIG. 22 is a schematic view illustrating still another conventional apparatus for producing a wire harness.

In the case where the electric wire elements a are cut off at the reinforcing tape 51 and are attached to the terminals t, two sheets of reinforcing tape 51 are spaced by a small distance away from each other and applied on the wire elements and then the wire elements a are cut off at an intermediate position between the tapes 51, as shown in FIG. 17. As shown in FIG. 18(*a*), a wide reinforcing tape 51 may be applied on the wire elements a and may be cut off at an intermediate position. Then, the cut-off end of the wire elements a may be stripped, as shown in FIG. 18(*b*).

It is possible in accordance with the present invention to produce an inexpensive flat electric wire for a wire harness and to enhance efficiencies of production of the flat electric wire and the wire harness.

What is claimed is:

1. A method for producing a wire harness, comprising the steps of;

initially winding a flat electric wire for a wire harness on a reel, said electric wire including a plurality of insulator-sheathed electric wire elements, each of said wire elements having a single core, juxtaposed on a plane, said flat electric wire having a length, parallel to said wire elements, and a width, perpendicular to said wire elements, and a plurality of reinforcing tapes adhered to said wire extending across said width and spaced apart from each other along said length;

drawing said flat electric wire from said reel;

measuring and cutting off said flat electric wire to form cut-off flat wire while clamping and drawing said flat electric wire and said reinforcing tape;

carrying said cut-off flat wire in a juxtaposed direction while holding opposite ends of said cut-of flat wire; and treating at least one end of said cut-off flat wire during said carrying step.

2. The method according to claim 1 wherein trailing ends of said reinforcing tapes engage a protrusion on a clamping surface of a clasper and said flat electric wire and said reinforcing tape are clamped and drawn.

* * * * *